United States Patent [19]

Bosch et al.

[11] 4,050,285

[45] Sept. 27, 1977

[54] AIR-HYDRAULIC BLIND-RIVETING TOOL WITH SHORT RESET TIME

[75] Inventors: Karl Bosch, Hermaringen, Brenz; Max Fritzenschaft, Giengen, Wurttemberg, both of Germany

[73] Assignee: Adolf Diener, Apparate- U. Maschinenbau, Hermaringen, Germany

[21] Appl. No.: 569,709

[22] Filed: Apr. 21, 1975

[30] Foreign Application Priority Data

Apr. 20, 1974 Germany ..... 2419190
Apr. 20, 1974 Germany ..... 7413845[U]

[51] Int. Cl.[2] ..... B21J 15/34

[52] U.S. Cl. ..... 72/391; 91/442; 137/517

[58] Field of Search ..... 72/391, 453; 91/442, 268; 137/517

[56] References Cited

U.S. PATENT DOCUMENTS

| | | | |
|---|---|---|---|
| 123,098 | 1/1872 | Goodale | 137/517 |
| 530,442 | 12/1894 | Munger | 137/517 |
| 934,286 | 9/1909 | Cole | 137/517 |
| 2,526,956 | 10/1950 | Kugler | 72/453 |
| 3,082,898 | 3/1963 | Bosch | 72/391 |
| 3,624,769 | 11/1971 | Hansen | 91/442 |

FOREIGN PATENT DOCUMENTS

| | | | |
|---|---|---|---|
| 1,306,344 | 9/1962 | France | 137/517 |

*Primary Examiner*—C.W. Lanham
*Assistant Examiner*—Gene P. Crosby
*Attorney, Agent, or Firm*—Montague & Ross

[57] ABSTRACT

An air-hydraulic blind-riveting tool has a chuck which is normally urged into a ready position by a spring and which is drawn into a retracted position by a fluid-operated piston connected via a hydraulic link to an air piston subdividing an air chamber of the tool into a front and a rear compartment. The front compartment is vented to the outside and the rear compartment is connectable via a trigger-operated valve to a source of compressed air. Thus when this rear compartment is pressurized the air piston is displaced forward and the working piston connected to the chuck is retracted. A valve is provided between the rear compartment and the atmosphere which comprises a valve disk displaceable by pressure in the rear compartment against a valve seat to prevent air from leaving the rear compartment but normally urged by a relatively stiff spring away from this valve seat. Thus during pressurization of the rear compartment this valve is closed, but as soon as the pressurization is partially relieved this valve opens and allows quick return of the air piston to the ready position.

6 Claims, 5 Drawing Figures

AIR-HYDRAULIC BLIND-RIVETING TOOL WITH SHORT RESET TIME

FIELD OF THE INVENTION

The present invention relates to a blind riveting tool. More particularly, this invention concerns an air-hydraulic tool for setting blind rivets.

BACKGROUND OF THE INVENTION

An air-hydraulic tool for setting a blind rivet is known comprising a housing forming an air chamber, a liquid-filled hydraulic chamber adjacent the air chamber, and a liquid-filled working chamber communicating with the hydraulic chamber. A working piston is provided in the working chamber and carries a chuck for grasping a mandrel of a blind rivet. This working piston is displaceable in the working chamber between a ready position wherein a mandrel can be fitted into the chuck and an actuated position wherein the chuck is retracted. An air piston is provided in the air chamber and subdivides it into a front compartment and a rear compartment. This air piston is displaceable between a front position and a rear position. The housing is formed with a front end of the front compartment with the first throughgoing hole for gas flow between the front compartment and the atmosphere. A hydraulic piston is carried on the air piston and is displaceable in the hydraulic chamber between an advanced position pressurizing the hydraulic chamber and corresponding to the front position of the air piston and a retracted position corresponding to the rear position of the air piston. A first valve is provided for admitting pressurized air into the rear compartment and thereby displacing the air piston into the front position, simultaneously displacing the hydraulic piston into the advanced position and displacing the working piston into the actuated position. A spring is braced between the housing and the working piston and urges this working piston into its ready position. Thus displacement of the working piston by the spring from the retracted position into the ready position automatically displaces the air piston into its rear position. The air in the rear compartment is usually driven out of the housing through the structure of the actuating valve which is intentionally made with loose tolerances so as to allow such leakage.

A disadvantage of such devices is, however, that the user must wait for the device to return to the ready condition after he has set a clinch nut. This is due to the fact that the pneumatic piston is pushed back into its starting position by the spring which is effective on the hydraulic piston that is connected to the mandrel-holding chuck. Thus once the trigger valve is released the return spring on the hydraulic piston attached to the chuck urges this element into its starting position thereby pressurizing the hydraulic chamber of the tool, and pressing back the pneumatic piston of the apparatus, which carries a piston that itself pressurizes the hydraulic chamber of the apparatus. Air in the pneumatic chamber must bleed out through the filling opening, and usually over the operator's hand so that a relatively long time elapses before the device is ready to use again. In addition the rush of air over the operator's hand has often found to be uncomfortable and to lead to the fouling of the device.

It has been suggested to overcome this difficulty by providing a larger inlet passage for the pneumatic chamber. This, however, requires greater pressure to operate the device and therefore slows down the operating time of the apparatus, although it does indeed decrease the time required for the tool to reset itself. The provision of a pressure-relief valve in the pneumatic chamber in no way decreases recycling time. A manually operated fast-acting bleed valve has been suggested, but this merely adds to the task of the operator.

OBJECTS OF THE INVENTION

It is therefore an object of the present invention to provide an improved riveting apparatus.

Another object of this invention is to provide an air-hydraulic blind riveting tool which quickly and automatically returns to the ready position after each riveting operation.

Still another object is the provision of such a tool which overcomes the above-given disadvantages.

SUMMARY OF THE INVENTION

These objects are attained according to the present invention in a tool wherein a second valve means is provided in a second hole in a wall of the air compartment for blocking air flow from the rear compartment out through the second hole when the first valve means is actuated to admit compressed air to the rear compartment. This valve means opens and allows air flow from the rear compartment out through the second hole only when the first valve means is not actuated. Thus in accordance with the present invention the rear compartment is automatically and very rapidly emptied into the atmosphere after each actuation of the tool. The air in the rear compartment is not simply allowed to leak out through the trigger valve mechanism, but is expelled directly into the atmosphere from the back of the tool.

According to another feature of this invention the air chamber of the housing is generally cylindrical and the housing has an end cap which constitutes the rear wall of the air chamber. The second valve means is provided in the end cap.

This second valve means according to the present invention includes a valve seat formed at the second hole and a valve disk sealingly engageable over this seat to block gas flow from the rear compartment. A spring is braced between the housing and the disk and urges the disk away from the seat and toward the rear compartment. This spring is relatively stiff so that when the rear compartment is connected to the source of compressed air the considerable pressure therein alone will suffice to press the disk down against the seal and close the valve. However, as soon as this rear compartment is disconnected from the source of compressed air the pressure in the rear compartment will drop somewhat and allow the stiff spring to push the disk away from the valve seat, thereby allowing the air in the rear compartment rapidly to rush out into the atmosphere through the second hole.

According to the present invention the fast-acting second valve arrangement advantageously serves at its side toward the rear compartment of the air chamber as a stop or abutment for the air piston.

The system according to the present invention allows a great many more rivets to be set in a given time than has hitherto been possible. In fact the return time, the time it takes the tool to be ready after an actuation, is reduced by a factor of 2 to 3. The device snaps back into the ready position so rapidly that the broken-off mandrel from the set rivet is automatically ejected and knocked out of the tool.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
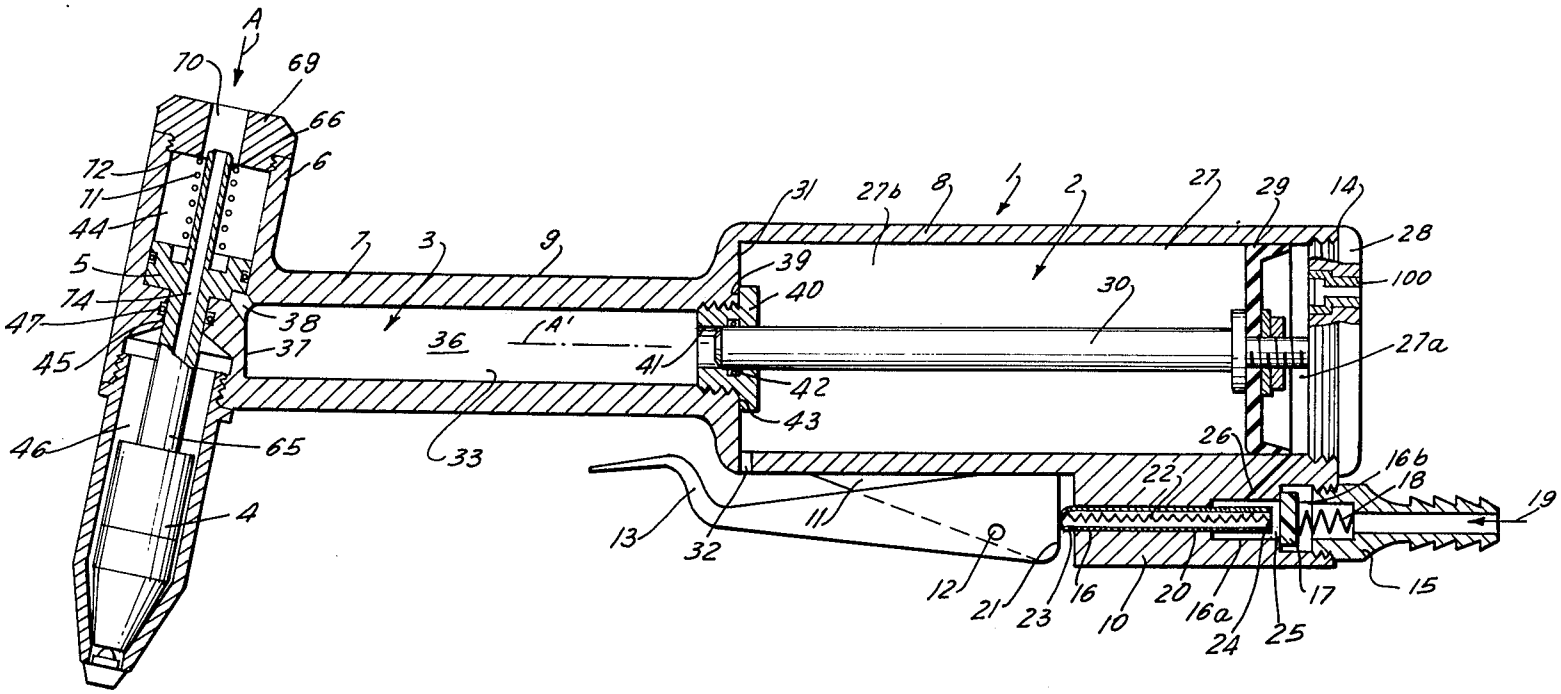
FIG. 1 is a longitudinal section through a riveting apparatus according to the present invention.

As shown in FIG. 1 the blind-riveting apparatus or pop riveter according to the present invention has a generally tubular housing 1 in which is provided a pneumatic actuator 2, a hydraulic actuator 3, and a rivet-gripping chuck 4 linked to a piston 5. A cylinder 6 for this piston 5 extends transverse to the longitudinal axis A' of the housing at an angle of approximately 75° thereto. The housing is divided into a small-diameter central section 7 holding the hydraulic actuator 3 and a large-diameter rear section 8 housing the pneumatic actuator 2. The section 7 is formed on its outer surface with ridges and acts as a handgrip for the apparatus, the center of gravity of the housing 1 lying within this grip region 7.

The section 8 is provided on its lower side with a projection 10 formed at its front side with a fork 11 in which an operating level 13 is pivoted about a pin 12 extending transverse to the axis A' and across the cheeks of the projection 10 at the groove 11. The rear end 14 of the section 8 is provided with a nipple 15 adapted to be connected to a source of compressed air. In addition this portion 10 is formed with a longitudinal bore 16 which is in line with the central hole through the nipple 15 and has a pair of stepped widened rear sections 16*a* and 16*b*.

A valve disk 17 of stiff elastomeric material is provided in the widest section 16*b* and overlies the back end of the bore 16, being urged against this bore by a compression spring 18 so as to prevent entry of air through the nipple in the direction of arrow 19. A tubular rod 20 is slidable in the bore 16 and has its front end engaging the rear of the lever 13 at a location 21 offset from the pivot 12. This rod 20 is hollow and closed at its front end 23. A long compression spring 22 is received within this hollow rod 20 and bears at its rear end 24 against the front face of the disk 17. The spring 18 is substantially stiffer than the spring 22 so that under normal circumstances the spring 18 pushes the disk 17 against the shoulder between the widened sections 16*a* and 16*b*. Normally a gap 25 is left between the end 24 of the rod 20 and the disk 17, but actuation of the lever 30 can press this end 24 against the disk 17 and move the disk 17 off its seat.

The widened section 16*a* is connected via a bore 26 to an air chamber 27 in the rear section 8 of the housing 1. A gland 29 divides the chamber 27 into a rear chamber 27*b* connected via the bore 26 to the portion 16*a* and a front section 27*b*. The gland 29 is bolted onto the rear end of a rod 30 that extends forwardly beyond the front end 31 of the chamber 27. A throughgoing hole 32 formed at the very front end of the chamber section 27*b* insures that the pressure in the chamber 27*b* will be the same as ambient pressure.

The hydraulic operator 3 comprises a chamber 33 filled with hydraulic fluid 36 and connected at its front end 37 via a bore 38 to the cylinder 6. A seal ring 40 formed with a throughgoing hole 41 and provided with O-ring seals 42 and 43 allows the piston rod 30 to be displaced into this chamber 33 without leakage of the hydraulic medium 36 backward into the chamber 27*b*. It is also possible to provide a gland similar to gland 29 on the front end of the rod 30 and eliminate the ring 40.

The front end 6 of the housing 1 is formed with three aligned bores 44, 45 and 46, the middle bore 45 being of substantially smaller diameter than the outer bores with an O-ring 47 sealing it in the central bore 45. This piston 65 carries at its one end the chuck 4 and is provided on its rear end with a piston 64 reciprocal in the bore 44 that forms an actuation cylinder for this piston 64. The upper end of the bore 44 is closed by a screwed-on cap 69 formed with a central hole 70. The piston 65 is formed with an axially throughgoing passage 74 terminating at its rear end in a tubular extension 66 around which is wound a compression spring 71 bearing at one end on the piston 64 and at the other end on the inner surface 72 of the cap 69. The spring 71 is quite stiff so that absent pressurization of the chamber 27*a* it will hold the piston in the position illustrated in FIG. 1 and, therefore, drive the piston 29 back into the illustrated position as indicated by arrow A.

Figure 2:
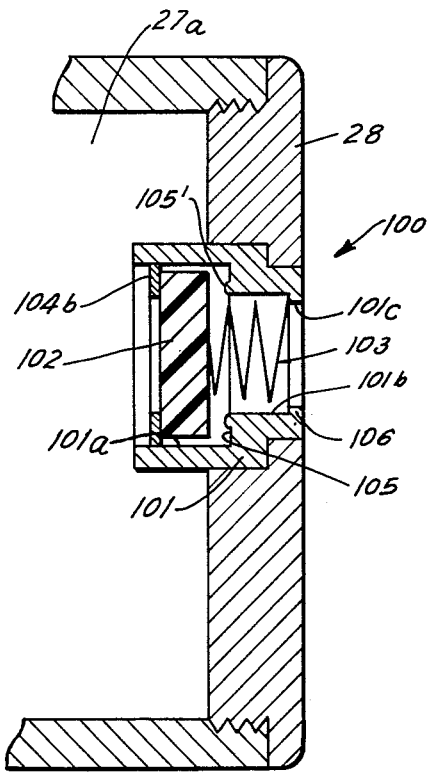
FIG. 2 is a sectional view in enlarged scale showing a bleed valve for the apparatus of FIG. 1.
Figure 3:
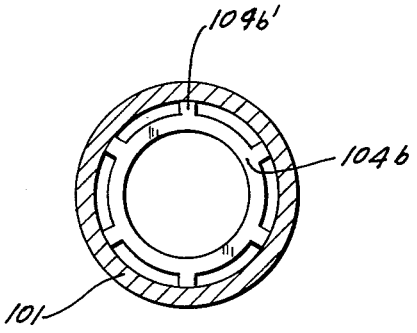
FIG. 3 is an end cross-sectional view showing the structure of the valve of FIG. 2.

The rear end cap 28 of the widened end section 8 of the housing 1 is provided with a fast-acting bleed valve 100 shown in more detail in FIG. 2. This valve 100 has a cylindrically stepped housing 101 having a front portion 101*a*, a smaller-diameter middle portion 101*b* separated from the front portion by a shoulder 105, and a yet smaller-diameter rear portion 101*c* separated from the portion 101*b* by a shoulder 106. A spring steel washer 104*b* shown in FIG. 3 has a plurality of radially extending tabs 104*b*' resiliently engaging the inner walls of the front section 104*b* and acts as a front seat for an elastomeric valve disk 102 of diameter sightly smaller than the section 101*a*. A spring 103 is braced at its rear end against the shoulder 106 and at its front end against the disk 102, pressing the disk against the washer 104*b*. The shoulder 105 is formed with an axially directed annular ridge 105' against which the disk 102 can be urged by air pressure in the chamber 27*a* to form a tight seal and prevent air from exiting from the chamber 27*a*.

Figure 4:
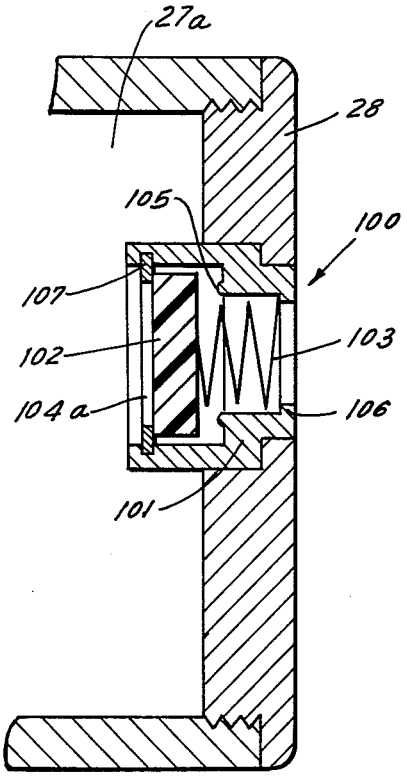
FIGS. 4 and 5 are views similar to FIGS. 2 and 3 showing another valve according to this invention.
Figure 5:
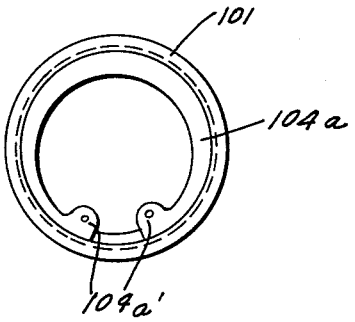

It is also possible as shown in FIGS. 4 and 5 to replace the washer 104*b* with a snap ring 104*a* received in a groove 107 in the housing 101. In both cases there is the possibility of air passage around the outside of the disk 102, either through the gaps between the tabs 104*b*' on the washer 104*b* or between the ends 104*a*' of the snap ring 104*a*. The housing 101 can be screwed into the cap 28 or simply force-fitted thereto.

The device described above functions as follows:

The mandrel of a blind rivet is fitted to the chuck 4. As shown in FIG. 1 the chamber 36 is completely filled with relatively noncompressible hydraulic fluid, and the piston 29 is in its rearward position. The valve disk 17 is pressed forward as also illustrated and air flow into and out of the chamber 27*a* around the valve element 102 is possible. A source of compressed air at 6 atmospheres of pressure is connected to the nipple 15.

Thereupon the lever 13 is actuated so as to press the tube 20 against the disk 17 and allow air to flow rapidly in the direction of arrow 19 through the section 16a and the passage 26 into the chamber 27a. The sudden pressurization of the chamber 27a pushes the element 102 back against the seat 105 and thoroughly blocks flow through the valve 100. The chamber 27a is then pressurized so as to advance the piston 30 which forces hydraulic fluid from the chamber 33 through the hole 38 so as to drive the piston 64 upwardly and pull on the mandrel of the rivet fitted in the chuck 4.

Once the rivet mandrel breaks the operator releases the handle 13. The pressurization of chamber 27a therefore is cut off so that the pressure therein drops considerably. The spring 103 is then effective to press the valve element 102 away from the seat 105. Air flow is then possible through the valve 100 so that as the spring 71 pushes the piston 64 down, the piston 30 is driven back by hydraulic pressure in the chamber 33 so as to push the piston 29 back to the position illustrated in FIG. 1. In this manner an extremely rapid return of the piston 29 to its ready position is obtained. It is in this manner possible to work more rapidly than with the prior art devices where all of the air had to bleed out through the passage 26.

We claim:

1. A tool for setting a blind rivet, said tool comprising:

a housing forming an air chamber, a liquid-filled hydraulic chamber adjacent thereto, and a liquid-filled working chamber communicating with said hydraulic chamber;

a working piston in said working chamber and carrying a chuck for grasping a mandrel of a blind rivet, said piston being displaceable in said working chamber between a ready position wherein a mandrel can be fitted into said chuck and an actuated position wherein said chuck is retracted;

an air piston in said air chamber subdividing same into a front compartment and a rear compartment and displaceable between a front position of maximum volume of said rear compartment and minimum volume of said front compartment and a rear position of minimum volume of said rear compartment and maximum volume of said front compartment, said housing being formed at the front end of said front compartment with a first throughgoing hole for gas flow between same and the atmosphere and at the rear end of said rear compartment directly in a wall thereof with a second throughgoing hole for gas flow between same and the atmosphere;

a hydraulic piston carried on said air piston and displaceable in said hydraulic chamber between an advanced position pressurizing said hydraulic chamber and corresponding to said front position of said air piston and a retracted position corresponding to said rear position of said air piston;

first valve means for admitting, when actuated, pressurized air into said rear compartment and thereby displacing said air piston into said front position, displacing said hydraulic piston into said advanced position, and displacing said working piston into said actuated position;

second valve means on said wall in said second hole and responsive to air pressure for blocking air flow from said rear compartment out through said second hole when said first valve means is actuated to admit compressed air to said rear compartment and for opening and allowing air flow from said rear compartment out through said second hole when said first valve means is not actuated, said air chamber being generally cylindrical and said housing having an end cap constituting a rear wall of said air chamber, said second valve means being provided in said end cap; and a spring braced between said housing and said working piston and urging same into said ready position, whereby displacement of said working piston from said retracted position into said ready position by said spring absent actuation of said first valve means automatically displaces said air piston into said rear position and forces air out of said rear compartment through said second hole, said second valve means including:

a valve seat formed at said second hole, a valve disk sealing engageable over said seat to block gas flow from said rear compartment, a valve spring braced between said housing and said disk and urging same away from said seat, an abutment element, said valve spring normally pressing said disk against said element, said element being formed with at least one gap for air flow through said second hole when said disk lies against said element, and a tubular spring housing fixed in said end cap and formed with a shoulder having said seat, said spring housing having an inner diameter greater than the outer diameter of said disk, said element being a washer having a plurality of angularly spaced and radially outwardly extending tabs engaging the inner wall of said tubular housing.

2. The tool defined in claim 1 wherein said spring housing has a first section surrounding said disk and of said inner diameter and a second section of lesser inner diameter separated from said first section by said shoulder.

3. The tool defined in claim 2 wherein said spring housing is formed with inwardly extending lip at the end of said second section opposite said shoulder, said spring in said spring housing bearing against said lip.

4. A tool for setting a blind rivet, said tool comprising:

a housing forming an air chamber, a liquid-filled hydraulic chamber adjacent thereto, and a liquid-filled working chamber communicating with said hydraulic chamber;

a working piston in said working chamber and carrying a chuck for grasping a mandrel of a blind rivet, said piston being displaceable in said working chamber between a ready position wherein a mandrel can be fitted into said chuck and an actuated position wherein said chuck is retracted;

an air piston in said air chamber subdividing same into a front compartment and a rear compartment and displaceable between a front position of maximum volume of said rear compartment and minimum volume of said front compartment and a rear position of minimum volume of said rear compartment and maximum volume of said front compartment, said housing being formed at the front end of said front compartment with a first throughgoing hole for gas flow between same and the atmosphere and at the rear end of said rear compartment directly in a wall thereof with a second throughgoing hole for gas flow between same and the atmosphere;

a hydraulic piston carried on said air piston and displaceable in said hydraulic chamber between an advanced position pressurizing said hydraulic chamber and corresponding to said front piston of said air piston and a retracted position corresponding to said rear position of said air piston;

first valve means for admitting, when actuated, pressurized air into said rear compartment and thereby displacing said air piston into said front position, displacing said hydraulic piston into said advanced position, and displacing said working piston into said actuated position;

second valve means on said wall in said second hole and responsive to air pressure for blocking air flow from said rear compartment out through said second hole when said first valve means is actuated to admit compressed air to said rear compartment and for opening and allowing air flow from said rear compartment out through said second hole when said first valve means is not actuated, said air chamber being generally cylindrical and said housing having an end cap constituting a rear wall of said air chamber, said second valve means being provided in said end cap; and a spring braced between said housing and said working piston and urging same into said ready position, whereby displacement of said working piston from said retracted position into said ready position by said spring absent actuation of said first valve means automatically displaces said air piston into said rear position and forces air out of said rear compartment through said second hole, said second valve means including:

a valve seat formed at said second hole, a valve disk sealing engageable over said seat to block gas flow from said rear compartment, a valve spring braced between said housing and said disk and urging same away from said seat, an abutment element, said valve spring normally pressing said disk against said element, said element being formed with at least one gap for air flow through said second hole when said disk lies against said element, and a tubular spring housing fixed in said end cap and formed with a shoulder having said seat, said spring housing having an inner diameter greater than the outer diameter of said disk, said spring housing being formed with a groove, said element being a snap ring fitted into said groove.

5. The tool as defined in claim 4 wherein said spring housing has a first section surrounding said disk and of said inner diameter and a second section of lesser inner diameter separated from said first section by said shoulder.

6. The tool as defined in claim 5 wherein said spring housing is formed with an inwardly extending lip to the end of said second section opposite said shoulder, said spring in said spring housing bearing against said lip.

* * * * *